US005574548A

United States Patent [19]

Iino et al.

[11] Patent Number: 5,574,548

[45] Date of Patent: Nov. 12, 1996

[54] METHOD AND DEVICE FOR DEVELOPING WITH A LIQUID

[75] Inventors: Shuji Iino, Muko; Toshimitsu Fujiwara, Kobe; Hidetoshi Miyamoto, Takatsuki, all of Japan

[73] Assignee: Minolta Camera Kabushiki Kaisha, Osaka, Japan

[21] Appl. No.: 419,616

[22] Filed: Apr. 10, 1995

[30] Foreign Application Priority Data

Apr. 18, 1994 [JP] Japan ..... 6-078817

[51] Int. Cl.[6] ..... G03G 15/10

[52] U.S. Cl. ..... 399/240; 430/117; 399/241; 399/249

[58] Field of Search ..... 355/245, 256, 355/257; 118/659, 660, 661, 662; 430/112, 114, 115, 116, 117

[56] References Cited

U.S. PATENT DOCUMENTS

| | | | |
|---|---|---|---|
| 3,815,989 | 6/1974 | Davis et al. | 355/256 X |
| 4,259,428 | 3/1981 | Tsuneda | 430/115 |
| 4,686,936 | 8/1987 | Chow | 118/661 |
| 4,707,112 | 11/1987 | Hartmann | 355/257 |
| 4,827,305 | 5/1989 | Enogu Chi et al. | 118/661 X |
| 5,089,853 | 2/1992 | Uematsu | 355/256 |
| 5,394,232 | 2/1995 | Tamura et al. | 355/256 X |

FOREIGN PATENT DOCUMENTS 1250214 10/1971 United Kingdom .

*Primary Examiner*—Sandra L. Brase

*Attorney, Agent, or Firm*—Burns, Doane, Swecker & Mathis, LLP

[57] ABSTRACT

Liquid developing method and liquid developing device for developing an electrostatic latent image formed on a latent image carrying member via a toner dispersed in a carrier liquid. An electrostatic latent image is formed on an image carrying surface, a liquid developer layer having a bottom layer of toner particles as the main constituent and a top layer of liquid carrier as the main constituent is formed on a developer holding surface and the electrostatic image is contacted with the top layer without substantially contacting the bottom layer with the image carrying surface. A member for maintaining a clearance between an image carrying member and a developer holding member at a predetermined space in which the top layer contacts with the electrostatic latent image without contacting the bottom layer to the image carrying member is provided.

24 Claims, 4 Drawing Sheets

METHOD AND DEVICE FOR DEVELOPING WITH A LIQUID

BACKGROUND OF THE INVENTION

1. Field of the Invention

The present invention relates to a liquid developing method and a liquid developing device for developing an electrostatic latent image formed on a latent image carrying member via a toner dispersed in a carrier liquid.

2. Description of the Related Art

Electrophotographic methods for image formation, wherein an electrostatic latent image formed on a latent image carrying member such as a photosensitive member or the like is developed by a charged toner, can be broadly divided into dry developing methods which directly employ a toner powder, and liquid developing methods which employ a liquid developer having a toner dispersed in a carrier liquid.

The liquid developing method was invented in 1955 by Mr. Metcalfe, a resident of Australia. In general, an electrostatic latent image formed on the surface of a photosensitive member is developed by immersing the photosensitive surface in a liquid developer. Typically, in liquid developing methods, images are obtainable which have high resolution and excellent halftones because toners having a small particle diameter are used. Moreover, toner images of such methods are advantageous inasmuch as they are easily fixed to a transfer member.

In recent years, demand has increased for images with more detail, and toner particles have been made even smaller in response to the demand. However, the mean particle diameter of toner is about 6 μm in dry developing methods. In contrast, the mean particle diameter is on the submicron level in liquid developing methods because the toner is dispersed in a liquid medium. Thus, liquid developing methods are advantageous in that they produce higher image quality.

In liquid developing devices which develop by liquid developing methods, toner is mechanically adhered to the photosensitive surface when liquid developer comes into contact with the photosensitive surface because the toner is dispersed in the liquid developer. This situation is the cause of background fogging.

For example, GB 1250214 proposes developing an electrostatic latent image by separating toner on an insulated belt immersed in a liquid developer, and having the thus formed toner layer transferred to an opposite surface.

However, all the conventional methods employ a developer layer (toner layer) directly in contact with a photosensitive surface thereby preventing the elimination of background fogging. Furthermore, toner temporarily adhered to a photosensitive surface becomes stressed when interposed between the photosensitive surface and the surface of a developing roller, thereby causing image disturbance.

SUMMARY OF THE INVENTION

In view of the previously described disadvantages, an object of the present invention is to provide a liquid developing method and a liquid developing device which inhibit background fogging generated by toner mechanically adhering to an electrostatic latent image carrying member and minimizes image disturbance.

The present invention achieves the aforesaid objects by providing a liquid developing method for developing electrostatic latent images formed on a latent image carrying surface using a liquid developer incorporating toner particles. The method includes a first step of forming an electrostatic latent image onto a holding surface, a second step of forming developing layers onto a developer carrying member, the developing layers including a bottom developing layer being formed by toner particles as a main component and a top developing layer being formed by a carrier liquid as a main component, the top layer being superposed over the bottom layer, and a third step of contacting the top developing layer to the electrostatic latent image without contact of the top developing layer with the holding surface.

Further, the present invention achieves the aforesaid objects by providing a liquid developing device for developing electrostatic latent images formed on a latent image carrying surface using a liquid developer incorporating toner particles and carrier liquid for dispersing the toner particles. The liquid developing device includes a developer carrying member arranged at a predetermined spacing relative to the latent image carrying member so as to carry liquid developer to the surface of the latent image carrying member, and means for carrying the liquid developer to the surface of the latent image carrying member comprising a bottom layer, the main constituent of which is toner particles and a top layer the main constituent of which is liquid medium. In the device, an electrostatic latent image is developed in a region opposite the latent image carrying member and the developer carrying member, with the liquid medium of the liquid developer top layer formed on the surface of the developer carrying member as it comes into contact with the surface of the latent image carrying member where the toner particles migrate from the liquid developer bottom layer via the liquid carrier.

In the present invention, a liquid developer layer is maintained on a developer carrying member, the liquid developer comprising a bottom layer, the main constituent of which is toner particles, and a top developer layer, the main constituent of which is a liquid medium. The liquid medium of the liquid developer top layer is maintained on the surface of a developer carrying member and comes into contact with the surface of the latent image carrying member in a region opposite the latent image carrying member and the developer carrying member. The electrostatic latent image formed on the surface of the latent image carrying member is developed by the selective migration of toner particles in accordance with the distribution of electrical charge of the electrostatic latent image from the liquid developer bottom layer via the aforesaid liquid medium. Thus, fogging and image disturbance are avoided because the toner portion does not directly contact the latent image. Furthermore, it is possible to set the density of the toner in the bottom layer extremely high to increase image density. Typically, if toner density in the developer layer is increased, adhesion of toner to regions outside the latent image is unavoidable such that toner density cannot be increased beyond a certain point. However, in the construction of the present invention, the liquid medium of the top layer comes into direct contact with the latent image, such that the toner density of the bottom layer can be increased completely without adhesion of toner to regions outside that of the latent image.

DESCRIPTION OF THE PREFERRED EMBODIMENTS

The preferred embodiments of the present invention are described hereinafter.

Figure 1:
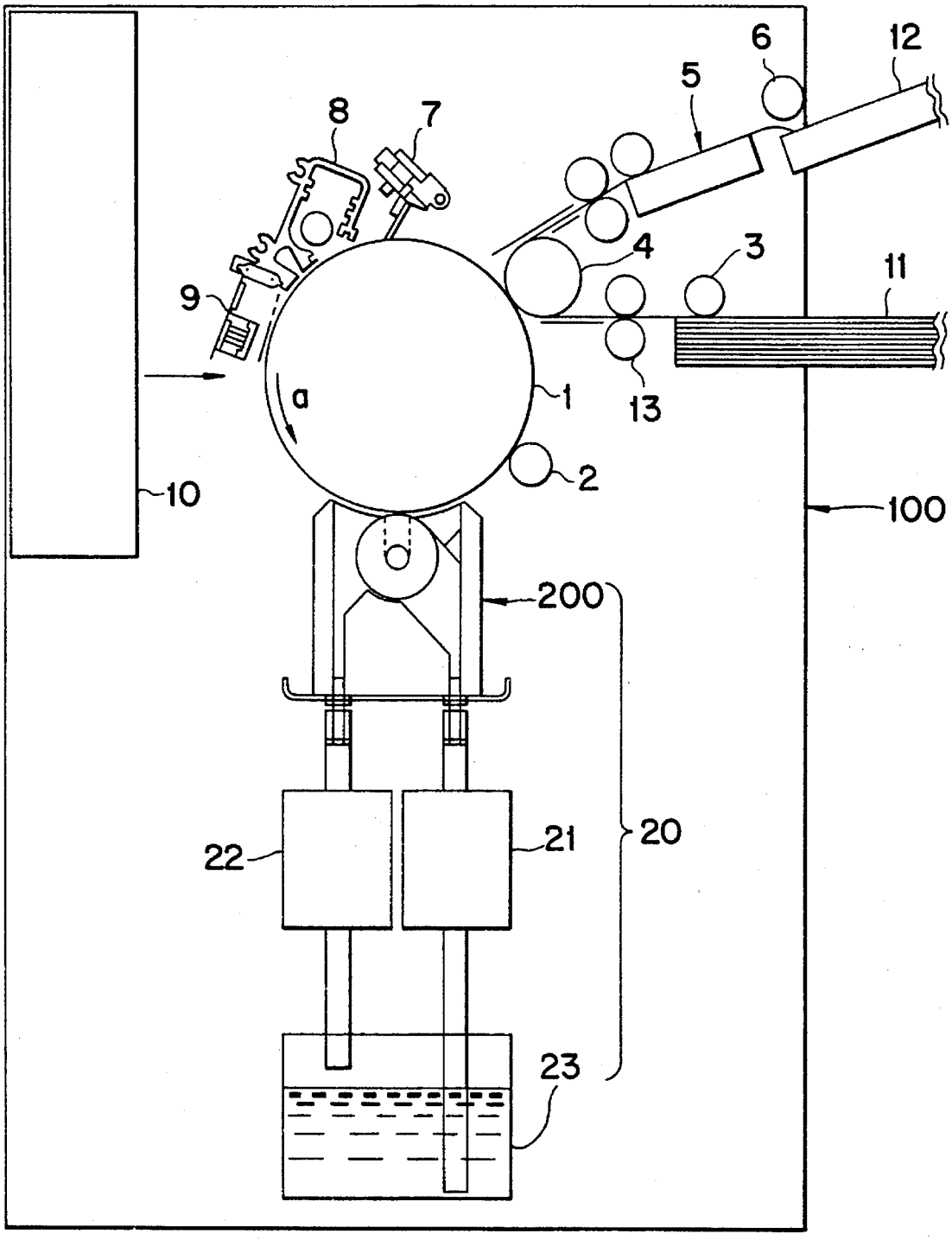
FIG. 1 is a sectional view showing electrophotographic printer 100 in which is installed a liquid developing device of the present invention.

FIG. 1 is a sectional view showing printer 100 of an electrophotographic type having a built in liquid developing device of the present invention. As shown in FIG. 1, the interior of printer 100 is provided with a cylindrical photosensitive drum 1 on the surface of which is formed electrostatic latent images and which is rotatable in the direction of the arrow in the drawing. Sequentially arranged around the periphery of photosensitive drum 1 are image forming process components including laser emitting device 10 for generating a laser beam in accordance with image data transmitted from a host computer or the like (not illustrated), liquid developing device 20, squeeze roller 2, transfer roller 4, cleaner 7, eraser lamp 8, and charger 9. At the side of printer 100 are provided paper cassette 11 accommodating paper, fixing device 5 for fixing a toner image formed on a paper sheet, and discharge tray 12 for receiving paper sheets discharged from within the printer.

When the printer is started, photosensitive drum 1 starts to rotate at a predetermined speed in the direction of the arrow, and the surface of the drum is uniformly charged by charger 9, and irradiated by a laser beam emitted from laser generating device 10 so as to form an electrostatic latent image thereon. This electrostatic latent image is developed by a liquid developer supplied from liquid developing device 20, and squeeze roller 2 is rotated while being brought into contact with photosensitive drum 1, such that excess liquid medium is removed via the rotation of squeeze roller 2.

Feed roller 3 provided adjacent to cassette 11 is rotated to transport a sheet from cassette 11 into the interior of printer 1. This sheet is transported to a position opposite photosensitive drum 1 and transfer roller 4 synchronously with the toner image formed on the surface of photosensitive drum 1, and the toner image on photosensitive drum 1 is transferred onto the sheet by transfer roller 4 to which is applied a voltage having a polarity opposite the polarity of the charged toner. After image transfer, the sheet is dried and the toner image is fixed to the surface of the sheet via fixing device 5, whereupon the sheet is ejected to discharge tray 12 via discharge roller 6.

As shown in FIG. 1, liquid developing device 20 is provided with developer storage tank 23 for storing liquid developer, liquid supply device 21 for scooping up liquid developer accommodated in developer storage tank 23, developing head 200 disposed opposite photosensitive drum 1 for developing electrostatic latent images formed on the surface of photosensitive drum 1 via liquid developer supplied by liquid supply device 21, and liquid collecting device 22 for returning liquid developer in developing head 200 to developer storage tank 23. The liquid developer accommodated within developer storage tank 23 receives replenishing toner at suitable times via a toner replenishing device (not shown in the drawing) so as to maintain a virtually constant toner density.

Figure 2:
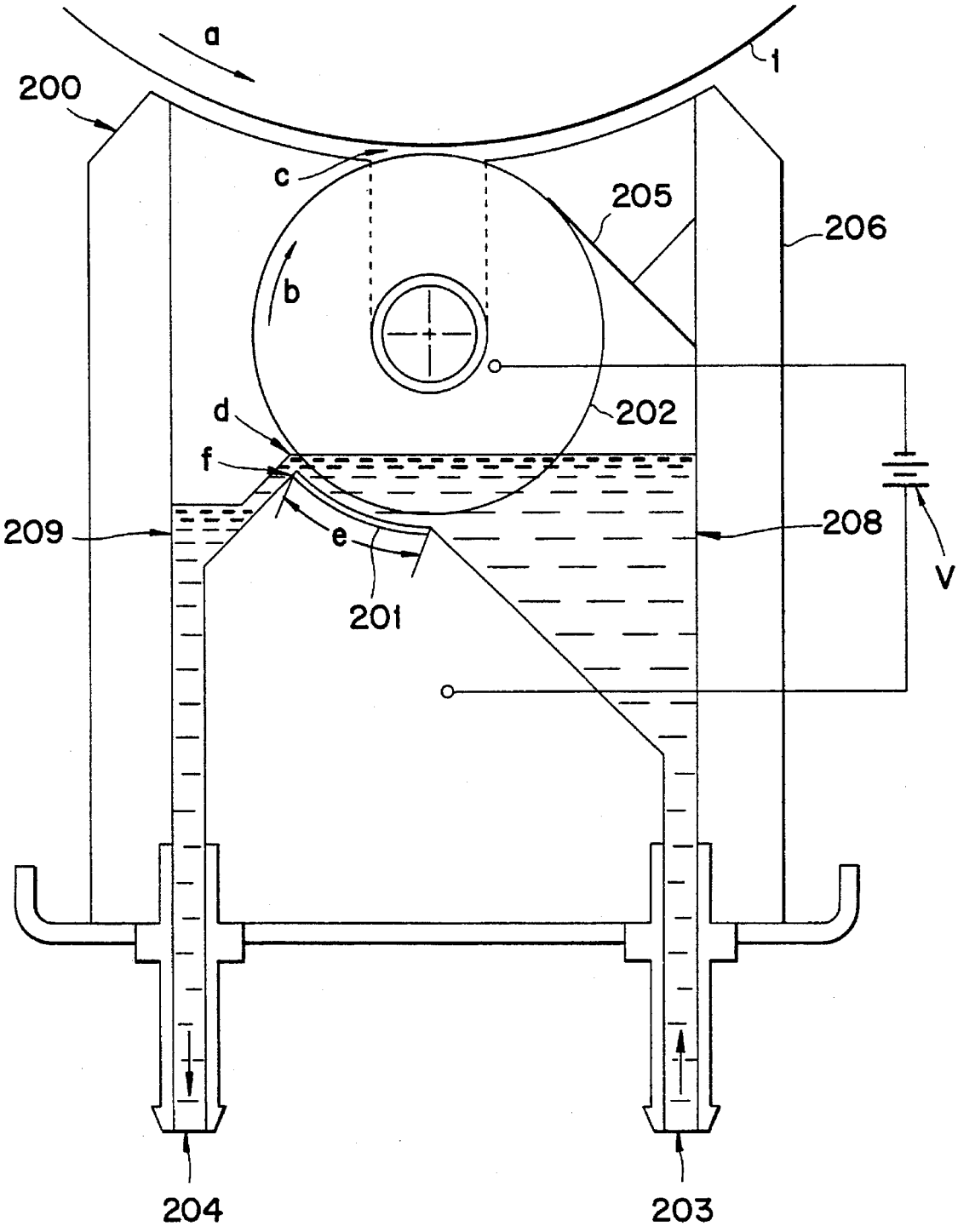
FIG. 2 is an enlargement of the vicinity of developing head 200 of liquid developing device 20.

FIG. 2 is an enlargement showing the vicinity of developing head 200. As shown in FIG. 2, developing head 200 is provided with developing roller 202 for carrying liquid developer on its surface, and frame 206 for supporting developing roller 202. The area shaded by diagonal lines indicates liquid developer.

Figure 3:
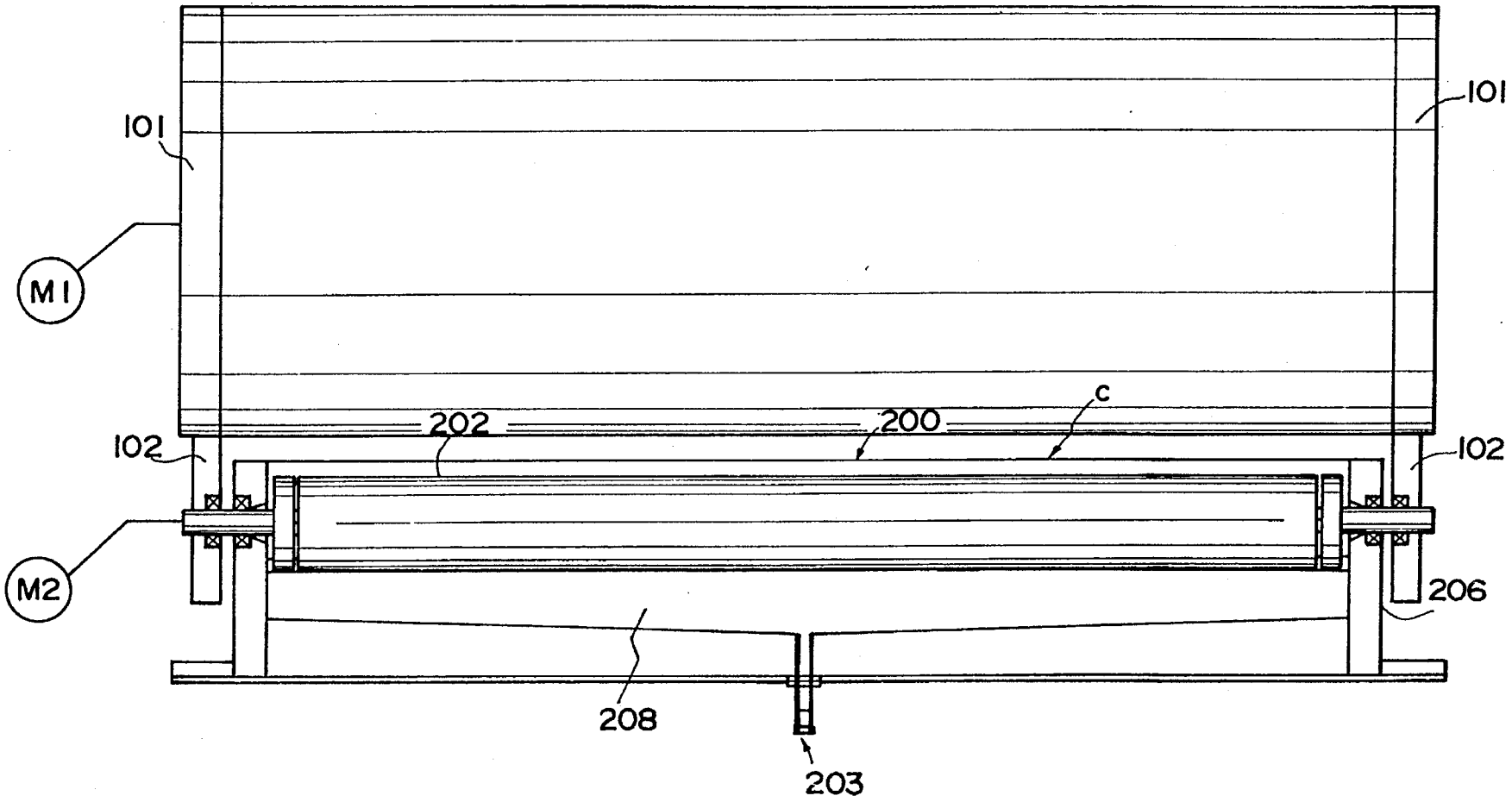
FIG. 3 is an illustration showing the construction of developing head 200 in the length direction.

Developing roller 202 is cylindrical in configuration and formed of an electrically conductive material. Developing roller 202 is arranged parallel to the lengthwise direction of photosensitive drum 1, and is rotatable in the arrow b direction in the drawing, i.e., in the same direction as the direction (arrow a) of rotation of photosensitive drum 1 in the area opposite photosensitive drum 1. FIG. 3 shows the construction of developing head 200 in the lengthwise direction.

As shown in FIG. 2, developing roller 202 confronts photosensitive drum 1 with a predetermined spacing therebetween. As described later, developing is accomplished in the area of confrontation between photosensitive drum 1 and developing roller 202, the area of confrontation being designated developing region c, and the spacing between photosensitive drum 1 and developing roller 202 in developing region c is designated the developing gap. The developing gap may be optionally set within a range of between about 0.1 and about 2 mm.

In the present invention, the value of the aforesaid developing gap is extremely important. That is, when the developing gap is too small, image density increases but background fogging (toner adhesion at regions other than that of the latent image) image disturbance occurs because the bottom layer of the liquid developer having high toner density makes direct contact with the electrostatic latent image. Conversely, when the developing gap is too large, the developer is divided into two layers thereby preventing background fogging and image disturbance but the time required for the movement of toner via electrical migration increases such that a suitable toner density may not be achieved at a practical developing speed. In contrast, the present inventors have found that a developing gap within a range of between about 0.1 and about 2 mm is optimum and satisfies the aforesaid situations. When the developing gap is less than 0.1 mm (100 μm), it is difficult to achieve adequate division between the developer bottom layer having a high toner density and the top layer which is virtually without toner. When the developing gap is over 2 mm (2,000 μm), the amount of toner moved to the latent image per unit time is inadequate in terms of the speed of electrical migration of the toner, thereby causing inadequate toner density.

The mechanism for maintaining the developing gap is described hereinafter with reference to FIG. 3.

On the same axis as developing roller 202 are provided rollers 102 having a radius which is larger than the roller 202 by the size of the developing gap only, the rollers 102 being mounted to the exterior sides of frame 206. On the other hand, photosensitive drum 1 is formed so as to be longer than developing head 200 in the lengthwise direction, as shown in the drawing. Bilateral ends 101 of photosensitive drum 1 expose the aluminum substrate of the drum on which no photosensitive layer is present. Rollers 102 make contact at the aforesaid bilateral ends 101 of the drum, thereby maintaining the developing gap. Photosensitive drum 1 is rotatably driven by motor M1, and rollers 102 are driven in rotation via the aforesaid rotation of photosensitive drum 1. On the other hand, roller 202 is rotatably driven by motor M2 so as to be rotated at a speed independent of the roller 102.

Below developing roller 202 is provided developer tank 208 for storing liquid developer within developing head 200. At the bottom of developer tank 208 is formed a fluid supply aperture 203 which is connected to fluid supply device 21. During development, liquid developer is supplied from fluid supply aperture 203 to developer tank 208, such that the bottom section of developing roller 202 is immersed in liquid developer within developer tank 208, as shown in FIG. 2.

Part of the top end of the wall surface forming developer tank 208 is adjacent to the bottom portion of developing roller 202, such that an edge portion f extends parallel to the lengthwise direction of the developing roller. Other wall surfaces forming developer tank 208 extend upward so as to cover developing roller 202. Collection tank 209 is provided adjacent to edge portion f, such that when liquid developer is supplied to developer tank 208 and the tank 208 becomes full to capacity, excess liquid developer overflows edge portion f and is collected in collection tank 209. In the bottom of collection tank 209 is formed a collection aperture 204 which is connected to collection device 22, such that liquid developer flowing into collection tank 209 is collected from collection aperture 204. The surface area of the opening facing the top portion of developer tank 208 and collection tank 209 gradually increases to form an inverted bell-like configuration.

The interior walls of developer tank 208 from edge portion f to the section confronting the lowermost point of developing roller 202 forms a circular surface 201 which maintains a predetermined spacing with developing roller 202. Circular surface 201 is an electrode, and a predetermined voltage is applied between the electrode 201 and developing roller 202.

When liquid developer fills the space between the aforesaid electrode 201 and developing roller 202, a power source (V) applies a voltage which generates an electric field to move the charged toner from electrode 201 toward developing roller 202, such that a thin layer of toner (i.e., an extremely high density toner layer) is formed on the surface of developing roller 202, and a layer of carrier liquid almost entirely without toner is formed thereabove due to the migration of the toner. Thus, electrode 201 is designated a layer-forming electrode, the space formed by layer-forming electrode 201 and developing roller 202 is designated layer-forming section d, and the space formed by layer-forming electrode 201 and developing roller 202 in layer-forming section d is designated the layer-forming gap.

A voltage applied between layer-forming electrode 201 and developing roller 202 may be selectively positive or negative in accordance with the polarity of the charged toner insofar as movement of the charged toner from electrode 201 toward roller 202 is achieved. A direct current, or alternating current overlaid on a direct current may be used, such that a pulse-like voltage overlays a direct current. The direct current constituent should be in a range of between about 100 and about 2,000 V, and preferably between about 200 and about 1,500 V. When an alternating current is overlaid, the voltage between peaks should be in a range of between about 200 and about 4,000 V, and preferably between about 400 and about 3,000 V, with a frequency of between about 10 and about 10,000 Hz.

When the length of layer-forming section d (range indicated by arrow e in FIG. 2) is set at between about 3 and about 80 mm, and preferably between about 5 and about 50 mm, adequate time is provided for toner migration necessary for thin layer formation, allowing a thin layer of developer having high toner density to be formed.

The layer-formation gap should be set at between about 0.1 and about 10 mm, and preferably between about 0.3 and about 3 mm, although the spacing between electrode 201 and roller 202 may be changed in accordance with the value of the applied voltage. This value should be sufficient to induce suitable flow of developer to layer-forming section d, and form the aforesaid liquid developer layer comprising a thin toner layer and liquid medium layer.

The operation of liquid developing device 20 is described in detail hereinafter.

When developing starts, liquid supply device 21 operates to supply liquid developer from liquid supply aperture 203 to developer tank 208. After the liquid developer passes through layer-forming section d and collection tank 209, it is collected in developer collection tank 23 by collection device 22 via collection aperture 204, and is again supplied to developing head 200 by liquid supply device 21. Thus, liquid developer is circulated within developing device 20 during development.

In developing device 20, the collection power of collection device 22 is greater than the supplying power of supply device 21. Accordingly, the fluid surface of developer within developing head 200 is virtually uniform with edge portion f of developer tank 208 (i.e., the top edge of layer-forming electrode 201) being the highest position. Thus, only the bottom portion of developing roller 202 is immersed in the liquid developer, thereby preventing the adhesion of unnecessary liquid to the developing roller 202.

A method may be used wherein the impedance of supply aperture 203 is greater than the impedance of collection aperture 204, such that the liquid collection power is slightly greater than the liquid supplying power.

At the start of development, developing roller 202 starts to rotate in the arrow b direction. A predetermined voltage is applied between layer-forming electrode 201 and developing roller 202, such that the charged toner particles within the liquid developer migrate to the developing roller 202 by means of an electrostatic force as the developer passes through layer-forming section d. Thus, a thin layer having a high density of toner particles is formed on the surface of developing roller 202, and a layer of carrier liquid having no toner particles is formed thereabove.

The thus formed liquid developer layers comprising a thin layer of high density toner and a layer of carrier liquid is carried to developing section c via the rotation of developing roller 202. The carrier liquid layer comes into contact with the surface of photosensitive drum 1. A predetermined developing bias voltage is applied to developing roller 202, such that toner particles of the toner layer are attracted by the electric field of the electrostatic latent image formed on the surface of photosensitive drum 1, and migrate through the carrier liquid to photosensitive drum 1, and develop the latent image by adhering to the latent image via a Coulomb force. At this time, the generation of background fogging and image disturbance are inhibited because the thin toner layer does not make direct contact with photosensitive drum 1, and high density images are obtained due to the presence of the high density toner layer as previously described.

After passing developing section c, the residual developer remaining on the surface of developing roller 202 is removed therefrom by scraper 205. The developing material may directly re-enter developer tank 208 without a special collection process, and again pass through layer-forming section d.

When developing is completed, the voltage applications cease, and operation of supply device 21, collection device 22, and developing roller 202 stops. Thus, the developer within developer tank 201 rapidly falls via its own weight toward developer storage tank 23 from supply aperture 203 and collection aperture 204. At this time, supply aperture 203 and collection aperture 204 are provided below developer tank 208 and collection tank 209, such that developer is completely removed from within developing head 200 because a concavity is not provided therebelow other than supply aperture 203 and collection aperture 204 within developer tank 208 and collection tank 209. Accordingly, when developing device 20 is at rest, toner adhesion due to drying and vapor generation within developing device 20 can be minimized.

The rotational speed of developing roller 202 is optimally identical with the rotation speed of photosensitive drum 1. In this instance, image disturbance can be minimized because shearing forces do not affect the toner adhering to photosensitive drum 1. When desirable, the rotational speeds of the drum and developing roller may differ, to increase the amount of toner supplied to photosensitive drum 1 when developing roller 202 rotates faster than the drum 1, and to reduce the amount f toner supplied to drum 1 when the speed of developing roller 202 is slower than the drum 1. Furthermore, developing roller 202 may be rotated in a direction opposite to the direction of rotation of photosensitive drum 1 in the confrontation area relative to the drum 1. In this instance, the amount of fluid adhering to photosensitive drum 1 is reduced.

The surface roughness of developing roller 202 has a ten-point mean roughness of 5 μm or less. This degree of surface roughness prevents image disturbance due to contact between the photosensitive drum 1 and developing roller 202, damage to the toner layer due to contact between the developing roller 202 and layer-forming electrode 201, developing irregularity due to a nonuniform electric field in developing section c, and nonuniform cleaning by scraper 205. Ten-point means surface roughness is defined in Japanese Industrial Standards publication JIS B0601.

The aforesaid liquid developer layer comprising a toner layer and carrier liquid layer may be formed via the action of a magnetic field when the toner is magnetic. Other optional methods may be used to similar effect, such as, for example, formation of a developer layer by mechanical means described below.

Figure 4:
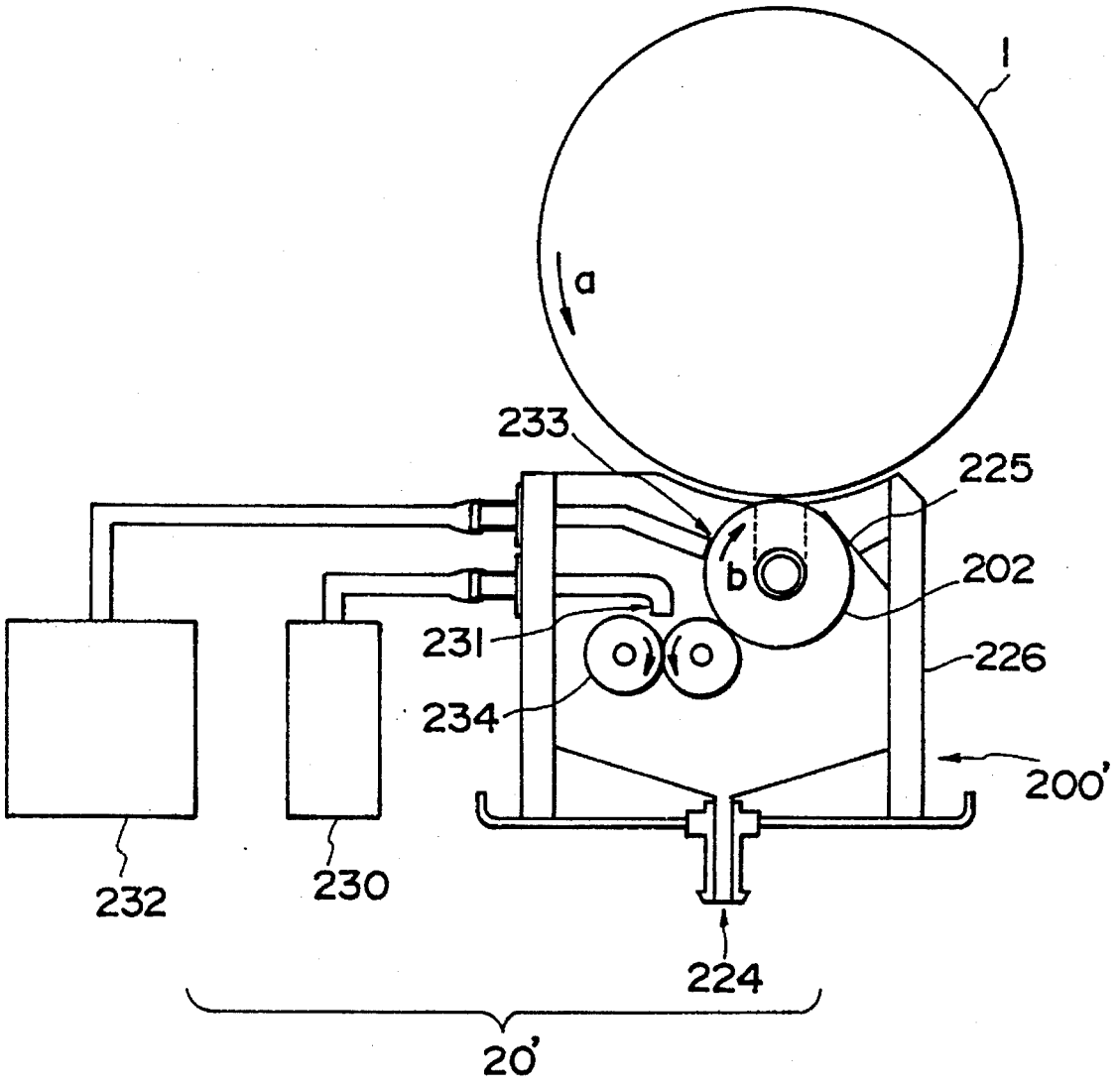
FIG. 4 is a sectional view showing liquid developing device 20' which has a construction different from that of FIG. 2.

FIG. 4 is a sectional view showing liquid developing device 20' for forming the aforesaid liquid developer layer by mechanical means. As shown in FIG. 4, liquid developing device 20' is provided with developing head 200', developing roller 202, and frame 226 in the same manner as developing device 20 shown in FIGS. 1 and 2.

A pair of application rollers 234 are provided in developing head 200' to spread toner on developing roller 202. One of the application rollers 234 is in contact with developing roller 202.

Within developing head 200', developer supply aperture 231 is provided opposite the nip portion of application roller 234. Developer supply aperture 231 is connected to developer supply device 230, and is provided with a plurality of openings in the lengthwise direction of the developing roller. Developer having a high toner density passes from the openings and is supplied onto application roller 234.

Adjacent to developing roller 202 is provided carrier liquid aperture 233 on the downstream side from application roller 234 in the direction of rotation of developing roller 202 (arrow b direction in the drawing). Carrier liquid aperture 233 is connected to carrier liquid supply device 232. Carrier liquid supply aperture 233 is also provided with a plurality of openings in the lengthwise direction of the developing roller, such that the carrier liquid is supplied from the opening onto developing roller 202.

Liquid collection aperture 224 is provided below developing roller 202 to collect liquid developer within developing head 200', and transport the developer to a collection tank not shown in the drawings.

When development starts, developing roller 202 and application rollers 234 begin rotation.

Toner supply device 230 is operated to supply liquid developer having a high toner density from toner supply aperture 231 to application roller 234.

Application rollers 234 are rotated in mutually opposite directions such that liquid developer supplied from toner supply aperture 231 passes through the nip section and is evenly distributed on application rollers 234. Developer is mechanically transferred onto the developing roller 202 which makes contact with application roller 234, thereby forming a thin toner layer on developing roller 202. The effect of an auxiliary electric field or magnetic field may be used when transferring toner from the application roller to the developing roller.

Then, carrier liquid supply device 232 is operated to supply carrier liquid from supply aperture 233 onto developing roller 202 on which is formed the thin toner layer. Thus, the thin toner layer is formed on the surface of developing roller 202, and a carrier liquid layer having no toner is superimposed over the thin toner layer.

The electrostatic latent image formed on the surface of photosensitive drum 1 is developed via the liquid developer layer formed on developing roller 202 in the same manner as previously described.

Liquid developer composition

The liquid developer used in the image forming apparatus of the present invention incorporates at least toner particles and a carrier liquid used as a carrier liquid. It is to be understood that other agents such as charge regulating agents, dispersion agents, dispersion stabilizing agents and the like may be added.

The mean volume particle size of toner particles is desirably regulated between about 0.5 and about 5 μm. Toner particle size should be regulated to within a mean volume particle size of ±1 μm per 80 percent-by-volume, and preferably ±0.5 μm per 80 percent-by-volume, to the total amount of toner particles. In the present invention, the particle diameter distribution of mean volume particle size was measured using a particle distribution measuring device (Shimadzu K.K., model SALD-1100).

Polymer micro particles obtained by either wet or dry manufacturing methods may be used as the aforesaid toner particles. Dry manufacturing methods include dry pulverization methods, spray drying methods and the like. Liquid manufacturing methods include in-solvent pulverization methods, suspension polymerization methods, emulsion polymerization methods, nonaqueous dispersion polymerization methods, seed polymerization methods, emulsion-dispersion-granulation methods and the like. Useful polymer particles manufactured by emulsion-dispersion-granulation methods or spray drying methods are desirable due to the many types of useable resins, the ease of molecular weight regulation, resin blending characteristics, and sharpness of particle diameter distributions. In-solvent pulverization methods are also advantageous insofar as toner particles can be inexpensively produced.

Emulsion-dispersion-granulation methods dissolve polymers in nonaqueous organic solvents to produce a polymer solution which is emulsion-dispersed in an aqueous solution to form an oil-in-water (O/W) type emulsion. This emulsion is heated while being agitated to vaporize the organic solvents, whereupon the polymer particles are extracted to obtain the polymer micro particles.

Spray drying methods dissolve polymers in organic solvents and regulate the polymer solution in which is dispersed coloring agents and other constituents. The obtained polymer solution is sprayed from nozzles and the spray is heated to vaporize the organic solvents and obtain the polymer micro particles.

When polymer particles of the aforesaid types are used as toner particles in a liquid developer, the polymer particles are washed and dried, and thereafter well known additives are added as required, such as, for example, charge regulating agents, dispersion enhancing agents, resins and the like. These polymer particles may then be dispersed in an insulative carrier liquid using an ultrasonic dispersion device or the like.

Resins useful for polymer particles are not specifically limited, and may include, for example, polyether resin, styrene-acrylic copolymer, polystyrene, polyvinyl chloride, polyvinyl acetate, polymethacrylate ester, polyacrylate ester, epoxy resin, polyethylene, polyurethane, polyamide, paraffin wax, and the like used individually or in blends.

Constituents such as coloring agents, charge regulating agents, offset inhibitors and the like may be added to the polymer particles as needed.

Various pigments and dyes such as carbon black, phthalocyanine and the like may be used as coloring agents. However, coloring agents may not be necessary when colored resins are used.

Electrically insulative organic substances may be used as the carrier liquid used in the liquid developer of the present invention, insofar as such substances do not change state at room temperature if they are in a fluid state during developing. Examples of useful substances include hydrocarbon resin, alicyclic hydrocarbons, aromatic hydrocarbons, halogenated hydrocarbons, polysiloxane and the like. However, normal paraffin and isoparaffin solvents are desirable in view of their low cost, odorlessness, and nontoxicity.

Specifically, Isobar-G, Isobar-H, Isobar-L, Isobar-K (Esso Co.), Shelzol-71 (Shell Oil Co.), IP Solvent 1620, IP Solvent 2028 (Idemitsu Sekkiyu Kagaku K.K.) are particularly desirable. Examples of useful substances which are solids at room temperature include waxes, paraffins and the like.

Charge regulating agents, dispersion agents, dispersion stabilizing agents and the like may be added to the carrier liquid of the liquid developer of the present invention.

A variety of common materials may be used as charge regulating agents. For example, to impart a positive polarity charge to the toner particles, metal salts of fatty acids such as stearic acid and the like, and metal salts of organic acids such as metal salts of sulfosuccinic acid ester, metal salts of abietic acid and the like, and solvent polymers such as alkyd resins to attract particles may be used. For example, to impart a negative polarity charge to the toner particles, surface-active agents such as lecithin and the like, nitrogen compounds, and solvent polymers such as polyamide resins for attracting particles may be used. The aforesaid charge regulating agents may be added at a rate in a range of between about 0.0001 and about 10 percent-by-weight, and preferably between about 0.001 and about 3 percent-by-weight of the carrier liquid.

Metal oxides such as $SiO_2$, $Al_2O_3$, $TiO_2$, ZnO and the like may be added as charge enhancing agents to the same amounts as charge regulating agents.

The previously mentioned types of surface active agents and solvent polymers may be used as dispersion agents and dispersion stabilizing agents to stabilize the dispersion of toner particles in the liquid developer.

Useful solvent polymers are not limited to the aforesaid examples inasmuch as polyolefin petroleum resins, linseed oil, polyalkylmethacrylate and the like, and low-weight copolymers of monomers having a polar group such as methacrylate, acrylate, alkylaminoethyl methacrylate and the like may be used to increase the affinity for the polymer particles. Solvent polymers should be added at a rate of between about 0.01 and about 20 percent-by-weight, and preferably between about 0.1 and about 10 percent-by-weight relative to the carrier liquid to improve dispersion characteristics, prevent elevation of viscosity due to its addition.

Examples of useful surface active agents include natural surface active agents such as saponin, nonionic surface active agents such as alkylene oxide, glycerine, glycidol and the like, and anionic surface active agents such as carbonic acid, sulfonic acid, phosphoric acid, and acidic radicals such as sulfate ester radical, phosphate ester radical and the like.

In the liquid developer used in the present invention, the ratio of solid constituents per total weight (solid content ratio) of toner, dispersion agents and the like is between about 1 and about 90 percent-by-weight per total amount of liquid developer. However, the aforesaid solid content ratio is preferably between about 2 and about 50 percent-by-weight to reduce the total amount of developer used in developing and for ease of handling.

Toner A production 100 parts low molecular weight polyester resin (MW: 15,000, Mn: 6,000) was dissolved completely in methylene chloride to obtain a density of 20 percent-by-weight. 6 parts phthalocyanine were dispersed in the resin solution as a coloring agent using an Eiger motor mill (Eiger Japan).

The resin solution was emulsion-dispersed in an aqueous dispersion fluid comprising 1% metrose 65SH-50 (Shin-Etsu Chemical Co.) and 1% sodium lauryl sulfate at 8,000 rpm for 30 min at room temperature using a Homomixer (Tokushu Kika Kogyo K.K.) to obtain an O/W type emulsion. The emulsion was then mixed by replacing the mixing blades for a four-blade type, and mixed for 3 hr at between 40° and 45° C. to extract methylene chloride. An aqueous suspension of micro polymer particles for use as toner having a mean volume particle size of 2 μm was obtained.

The obtained aqueous suspension of micro polymer particles for toner was centrifuged to remove the solids, which were washed, filtered, and dried to obtain micro polymer particles for toner having a mean volume particle size of 2 μm.

Toner B production

Toner B was produced in the same sequence as toner A with the exception that the Homomixer speed was 12,000 rpm to obtain micro polymer particles for toner having a mean volume particle size of 0.5 μm.

Toner C production

Toner C was produced in the same sequence as toner A with the exception that the Homomixer speed was 5,000 rpm to obtain micro polymer particles for toner having a mean volume particle size of 5 μm.

TABLE 1

| | Toner A | Toner B | Toner C |
|---|---|---|---|
| Mixing speed | 8,000 rpm | 12,000 rpm | 5,000 rpm |
| Mean particle size | 2 μm | 0.5 μm | 5 μm |

Developer A production 80.0 parts of toner A 26.7 parts lauryl methacrylate-methacrylate copolymer, and 13.3 parts n-hexyltrimethoxysilane were added to 880 parts electrically insulative isoparaffin solvent IP Solvent 1620 (Idemitsu Sekkiyu Kagaku K.K.), and dispersed for 20 min using an ultrasonic dispersion device to obtain liquid developer A.

Developer B

Liquid developer B was produced in the same sequence as liquid developer A with the exception that toner B was substituted for toner A.

Developer C

Liquid developer C was produced in the same sequence as liquid developer A with the exception that toner C was substituted for toner A.

Developer D

Liquid developer D was produced by the same method as developer A using 33.3 parts toner A, 11.1 parts lauryl methacrylate-methacrylate copolymer, and 5.56 parts n-hexyltrimethoxysilane added to 950 parts isoparaffin solvent IP Solvent 1620 (Idemitsu Sekkiyu Kagaku K.K.).

Developer E

Liquid developer E was produced by the same method as developer A using 333 parts toner A, 111 parts lauryl methacrylate-methacrylate copolymer, and 55.6 parts n-hexyltrimethoxysilane added to 500 parts isoparaffin solvent IP Solvent 1620 (Idemitsu Sekkiyu Kagaku K.K.).

Developer F

Liquid developer F was produced by the same method as developer A using 160 parts toner A, 53.3 parts lauryl methacrylate-methacrylate copolymer, and 26.7 parts n-hexyltrimethoxysilane added to 760 parts isoparaffin solvent IP Solvent 1620 (Idemitsu Sekkiyu Kagaku K.K.).

Toner particles in each of the liquid developers produced as described above were all charged to a positive polarity.

Ten-point mean surface roughness of developing roller: 2 μm

Developing gap: 200 μm

Voltage applied to developing roller: +550 V

Layer-forming gap: 1 mm

Voltage applied to layer-forming electrode: +1550 V (Voltage applied to layer-forming gap: 1000 V)

Fluid flow: 200 cc/min

Length of developing area in length direction of developing roller: 320 mm

RPM of photosensitive drum: 20 cm/s (Embodiments 4, 6, 7, 10, 11, Reference Examples 1 and 2) 20 mm/s (Embodiments 5, 8, 9)

RPM of developing roller: 20 cm/s

Surface potential of unexposed region of photosensitive drum: +750

Surface potential of exposed region of photosensitive drum: +50 V

Developing roller diameter: 30 mm n

Layer thickness of the fluid layer formed on the developing roller was measured by a compact laser measuring device LS-3002 (Keynes), to measure the potential difference on the roller surface (fluid surface) when a fluid layer was adhered and not adhered. The measured fluid layer thickness was about 50 μm.

However, when the photosensitive drum was mounted and the developing operation executed, it was found that fluid filled the 200 μm developing gap. This is believed to have been the result of developer being supplied to the developing device such that a thick fluid layer came into contact with the photosensitive member when the developing device started operation slowly, with the result that the thick fluid layer was maintained when the developing roller rotated at a predetermined speed. Another reason for this may be that excess fluid returned from the squeeze device was returned to the developing device, thereby creating an actual increase in the amount of fluid. Still another reason for this may be that the cleaning fluid used to clean the photosensitive drum or, more likely, the fluid adhering to the photosensitive drum remained on the surface of a portion of the photosensitive drum after passing through the cleaning device.

Accordingly, in view of the above, the thickness of the fluid layer was identical to the developing gap, i.e., 200 μm.

TABLE 2

| | Developer A | Developer B | Developer C | Developer D | Developer E | Developer F |
|---|---|---|---|---|---|---|
| Toner | A | B | C | A | A | A |
| | 80.0 g | 80.0 g | 80.0 g | 33.3 g | 33.3 g | 33.3 g |
| lauryl methacrylate-copolymer | 26.7 g | 26.7 g | 26.7 g | 11.1 g | 11.1 g | 53.3 g |
| n-hexyltrimethoxysilane | 13.3 g | 13.3 g | 13.3 g | 5.56 g | 5.56 g | 5.56 g |
| Carrier fluid | 880 g | 880 g | 880 g | 950 g | 500 g | 760 g |
| Solid content ratio | 12 pbw | 12 pbw | 12 pbw | 5 pbw | 50 pbw | 24 pbw |

pbw = percent-by-weight

EMBODIMENT 1

Reversal development was performed using developer A in the electrophotographic printer 100 of FIG. 1 and the liquid developing device of FIG. 2 under the following conditions.

When the roller was stopped and fluid on the surface of the roller was extracted, the aspirated fluid was nearly colorless, and it was understood that the toner density was extremely minute.

When the roller was stopped and the roller absorbing the fluid from the roller surface was dried, the toner adhering to the roller surface was collected using a polyurethane blade and measured. It was found that the amount of toner adhesion per unit area was about 0.5 mg/cm$^2$.

This finding indicates the toner layer was about 5 μm (gap clearance of zero).

Generally, the fluid layer thickness is desirably regulated at between about 2 and about 400 times the toner layer thickness. Specifically a thickness of between about 1 and about 2,000 μm is preferred.

There is concern that, when the thickness is less than 1 μm, contact between the photosensitive drum and the toner may not be preventable. The upper limit of fluid layer thickness is practically determined by the developing gap. A developing gap of less than 2 mm is desirable, and less than 500 μm is preferred.

The desired thickness of the toner layer, is determined by the speed ratio of the photosensitive drum and developing roller, toner diameter, and the ratio of the coloring agent (pigment, dye) incorporated in the toner. In general, a thickness of between about 0.5 and about 15 μm is desirable.

EMBODIMENT 2

Experiments were conducted under the same conditions as Embodiment 1 with the exception that developer B was used.

EMBODIMENT 3

Experiments were conducted under the same conditions as Embodiment 1 with the exception that developer C was used.

EMBODIMENT 4

Experiments were conducted under the same conditions as Embodiment 1 with the exception that developer D was used and the fluid flow rate was 480 cc/min.

EMBODIMENT 5

Experiments were conducted under the same conditions as Embodiment 1 with the exception that developer E was used and the fluid flow rate was 480 cc/min.

EMBODIMENT 6

Experiments were conducted under the same conditions as Embodiment 1 with the following exceptions. Electrophotographic printer shown in FIG. 1 and fluid developing device 20' in FIG. 4 were used. Liquid developing device 230 supplied developer F at a rate of 100 cc/min, and fluid supply device 232 supplied fluid at a rate of 100 cc/min. IP Solvent 1620 (Idemitsu Sekkiyu Kagaku K.K.) alone was used as the carrier constituent of the developer. A voltage of +1,000 V was applied between roller 234 and roller 202 to generate an electric field therebetween for the positively charged toner. Other conditions were identical with those of Embodiment 1.

The thickness of the fluid layer was measured and found to be identical to that of Embodiment 1, i.e., about 50 μm. When the photosensitive drum was mounted and a developing operation executed, the actual fluid layer thickness was identical to the developing gap, i.e., 200 μm. This value is meaningful with respect to the effectiveness of the present invention.

The thickness of the toner layer was measured and found to be identical to that of Embodiment 1, i.e., about 25 μm.

EMBODIMENT 7

Experiments were conducted under identical conditions to those of Embodiment 1 with the exception that the developing gap was set at 100 μm.

EMBODIMENT 8

Experiments were conducted under identical conditions to those of Embodiment 1 with the exception that the developing gap was set at 1 mm.

EMBODIMENT 9

Experiments were conducted under identical conditions to those of Embodiment 1 with the exception that the developing gap was set at 2 mm.

EMBODIMENT 10

Experiments were conducted under identical conditions to those of Embodiment 1 with the exception that the ten-point mean surface roughness of the developing roller was 5 μm.

EMBODIMENT 11

Experiments were conducted under identical conditions to those of Embodiment 1 with the exception that the developing gap was set at 500 μm.

Results of these experiments are described below.

REFERENCE EXAMPLE 1

Experiments were conducted under identical conditions to those of Embodiment 1 with the exception that the developing gap was set at 0 μm, i.e., the surface of developing roller 202 was in contact with the surface of photosensitive drum 1.

REFERENCE EXAMPLE 2

Experiments were conducted under identical conditions to those of Embodiment 1 with the exception that a voltage was not applied to layer-forming electrode 201.

Evaluation of image density

After development, toner on the exposed portion of photosensitive drum 1 (i.e., the image portion) was dried, and subsequently removed using a polyurethane blade, then measured. The value of the toner per unit surface area of the photosensitive drum was calculated and designated the amount of adhered toner. Image density was evaluated by the following standards based on the aforesaid calculated value. A rating of n was passing.

n : amount of adhered toner 0.30 mg/cm$^2$ or greater

X: Amount of adhered toner less than 0.30 mg/cm$^2$

Evaluation of background fog

Evaluations were performed in the same manner as for image density. The amount of toner adhered to the unexposed area of the photosensitive drum (i.e., non-image area) was measured to evaluate background fogging. A rating of n was passing.

n : amount of adhered toner 0.15 mg/cm$^2$ or greater

X: Amount of adhered toner less than 0.15 mg/cm$^2$

Presence of image disturbance

The presence or absence f image disturbance was evaluated visually after the toner image was fixed to a copy sheet. The results of these evaluations are shown in Table 3. In the table, toner layers and fluid layers were measured simultaneously by the same methods as described in Embodiment 1.

TABLE 3

| | Developing device FIG. | Developing gap | Toner layer | Fluid layer | Developer pbw | | Ten-point mean surface roughness μm | Layer-forming potential V | Image density | Fog | Image disturbance |
|---|---|---|---|---|---|---|---|---|---|---|---|
| Emb 1 | 1 | 200 μm | 5 μm | 195 μm | A | 12 | 2 | 1000 | n | n | n |
| Emb 2 | 1 | 200 μm | 5 μm | 195 μm | B | 12 | 2 | 1000 | n | n | n |
| Emb 3 | 1 | 200 μm | 5 μm | 195 μm | C | 12 | 2 | 1000 | n | n | n |
| Emb 4 | 1 | 200 μm | 5 μm | 195 μm | D | 5 | 2 | 1000 | n | n | n |
| Emb 5 | 1 | 200 μm | 50 μm | 150 μm | E | 50 | 2 | 1000 | n | n | n |
| Emb 6 | 4 | 200 μm | 25 μm | 175 μm | F | 24 | 2 | 1000 | n | n | n |
| Emb 7 | 1 | 100 μm | 5 μm | 95 μm | A | 12 | 2 | 1000 | n | n | n |
| Emb 8 | 1 | 1 mm | 50 μm | 950 μm | A | 12 | 2 | 1000 | n | n | n |
| Emb 9 | 1 | 2 mm | 50 μm | 1950 μm | A | 12 | 2 | 1000 | n | n | n |
| Emb 10 | 1 | 200 μm | 5 μm | 195 μm | A | 12 | 2 | 1000 | n | n | n |
| Emb 11 | 1 | 200 μm | 5 μm | 195 μm | A | 12 | 2 | 1000 | n | n | n |
| Ref Ex 1 | 1 | 0 μm | 5 μm | 0 μm | A | 12 | 2 | 1000 | n | x | x |
| Ref Ex 2 | 1 | 200 μm | Non-layer | Non-layer | A | 12 | 2 | 0 | x | x | n |

In each of the aforesaid embodiments, a developer layer comprising a thin toner layer and a carrier liquid layer was formed on the surface of a developing roller, the fluid layer portion came into contact with the surface of a photosensitive drum, and toner from the toner layer migrated to the surface of the photosensitive drum to develop and electrostatic latent image formed thereon. In all cases, excellent images were obtained with negligible background fogging and image disturbance.

The developer of Refer Example 1 did not adequately inhibit the generation of background fog. Examination of the obtained image verified image disturbance such as scratches parallel to the direction of advance of the photosensitive drum.

The developers of Reference Examples 2 and 3 did not produce acceptable image densities, and Reference Example 3 in particular was unable to adequately inhibit the generation of background fog.

In the present invention, a liquid developer layer comprising a bottom layer the main constituent of which is toner and a top layer the main constituent of which is carrier liquid is formed on a developer carrying member. The carrier liquid of the top layer of the developer formed on the developer carrying member comes into contact with the surface of an electrostatic latent image carrying member, and the latent image formed on the surface of the latent image carrying member is developed by the migration of toner particles from the bottom layer of the developer. Accordingly, background fogging and image disturbance can be effectively inhibited because the bottom layer of the developer the main constituent of which is toner does not come into direct contact with the surface of the latent image carrying member.

What is claimed is:

1. A method for developing with a liquid comprising:

forming an electrostatic latent image on an image carrying surface;

forming a liquid developer layer on a developer holding surface, said layer comprising a bottom layer having as a main constituent charged toner particles and a top layer having as a main constituent a liquid carrier; and contacting the electrostatic latent image with the top layer without substantially contacting the bottom layer with the image carrying surface.

2. The method of claim 1 further comprising a step of forming an electric field between the image carrying surface and developer carrying surface, said field orienting the charged toner from the developer carrying surface to the image carrying surface.

3. A liquid developing device comprising:

an image carrying member on which an electrostatic latent image is formed;

a developer holding member holding a developer layer including a bottom layer having as a main constituent charged toner particles and a top layer having as a main constituent a liquid carrier; and a clearance maintaining device for maintaining a clearance between the image carrying member and the developer holding member at a predetermined space in which the top layer contacts with the electrostatic latent image without contacting the bottom layer to the image carrying member.

4. The liquid developing device of claim 3 wherein the space between said developer carrying member and said latent image carrying member is between about 0.1 and about 2 mm.

5. The liquid developing device of claim 4 wherein a thickness of the bottom layer having 5 (micro-meter) to 50 (micro-meter).

6. The liquid developing device of claim 3 wherein the toner particles having a mean volume particles size between 0.5 (micro-meter) to 5 (micro-meter).

7. The liquid developing device of claim 3 wherein the toner particles having a size distribution within the mean volume particles size of ±1 (micro-meter) per 80% by volume.

8. The liquid developing device of claim 3 wherein the toner particles comprise a resin selected from the group consisting of polyether resin, styrene-acrylic copolymer, polystyrene, polyvinyl chloride, polyvinyl acetate, polymethacrylate ester, polyarylate ester, epoxy resin, polyethylene, polyuretane, polyamide and paraffin wax.

9. The liquid developing device of claim 3 wherein the liquid carrier is selected from the group consisting of normal paraffin and isoparaffin solvent.

10. The liquid developing device of claim 3 wherein the liquid carrier further comprises a charge regulating agent selected from the group consisting of metal salt of stearic acid, metal salt of sulfosuccinic acid ester, metal salt of abietic acid, alkyd resin, lecithin, nitrogen compound and polyamide resin.

11. The liquid developing device of claim 10 wherein the charge regulating agent is comprised between 0.0001 to 10% by weight to the liquid carrier.

12. The liquid developing device of claim 3 wherein the liquid carrier further comprises a solvent polymer selected from the group consisting of polyolefin petroleum resin, linseed oil, polyalkylmethacrylate, methacrylate, acrylate and alkylaminoethyl methacrylate.

13. The liquid developing device of claim 12 wherein the solvent polymer is comprised between 0.01 to 20% by weight to the liquid carrier.

14. The liquid developing device of claim 3 wherein the liquid carrier further comprises a surface active agent selected from the group consisting of saponin, alkylene oxide, glycerine, glycidol, carbonic acid, sulfonic acid, phosphoric acid, sulfate ester radical and phosphate ester radical.

15. The liquid developing device of claim 3 wherein the developer holding member is in the shape of a roller and the clearance maintaining means is a roller which has a larger diameter than that of the roller shaped developer holding member and disposed at the end of the developer holding member, said clearance maintaining roller contacting the image carrying member with rotating in order to maintain the space.

16. The liquid developing device of claim 15 further comprising:

a toner attracting electrode disposed to the surface of the developer holding member;

a supplying device supplying the developer to an area between the toner attracting electrode and the developer holding member, said supply developer including charged toner particles and a liquid carrier; and an electric field generator generating an electric field between the toner attracting electrode and the developer holding member in order to separate charged toner particles included in the supplied developer from the liquid carrier.

17. A liquid developing device of claim 15 further comprising:

a first toner supplying device supplying a first developer including toner particles and a liquid carrier to the surface of the developer holding member; and a second toner supplying device supplying a second developer to the surface of a developer carrying member which is supplied with the first developer wherein said second developer has a larger concentration of the liquid carrier than that of the first developer.

18. A liquid developing device comprising:

an image carrying member on which an electrostatic latent image is formed;

a rotating roller confronting the electrostatic latent image at a developing area;

an electrode which is shaped to be rounded along the surface of the rotating roller and is disposed to confront the surface of the rotating roller;

a supply device supplying developer comprising charged toner particles and carrier liquid to an area between the rotating roller and the electrode;

an electric field generator generating an electric field between the electrode and the rotating roller for separating charged toner particles included in the supplied developer from the liquid carrier in order to hold a developer layer including a bottom layer having as a main constituent charged toner particles and a top layer having as a main constituent charged toner particles and a top layer having as a main constituent a liquid carrier on the surface of the rotating roller; and a clearance maintaining device for maintaining a clearance between the image carrying member and the rotating roller at a predetermined space in which the top layer contacts with the electrostatic latent image without contacting the bottom layer to the image carrying member.

19. A liquid developing device of claim 18 wherein an area which is formed between the electrode and the rotating roller has a length of 3 (mm) to 80 (mm) as measured around the circumference of the rotating roller.

20. A liquid developing device of claim 18 further comprises a scrape blade which is disposed at a downstream side of the developing area with respect to the rotating direction of the roller and scrapes the bottom layer and the top layer from the surface of the rotating roller.

21. A liquid developing device of claim 18 wherein a surface of the rotating roller has a ten-points roughness under 5 (micro-meter).

22. A liquid developing device of claim 18 wherein the electric field generator applys a direct-current voltage of 100 (volts) to 2000 (volts) between the rotating roller and the electrode in order to generate an electric field therebetween.

23. A liquid developing-device of claim 22 wherein the electric field generator further applys a alternative-current voltage having a peak-to-peak voltage of 200 (volts) to 4000 (volts) and frequency of 10 (Hz) to 10000 (Hz) between the rotating roller and the electrode.

24. A liquid developing device of claim 18 further comprises a collecting device collects surplas toner particles and surplus liquid carrier which are supplied by the supply device.

* * * * *